US005581939A

United States Patent [19]

Regan et al.

[11] Patent Number: 5,581,939

[45] Date of Patent: Dec. 10, 1996

[54] UNIVERSAL QUICK RELEASE SAFETY SPROCKET AND DRIVING ASSEMBLY

[76] Inventors: William D. Regan, 7298 S. Zephyr Way; Tom F. Trautman, 7415 W. Walker, both of Littleton, Colo. 80123

[21] Appl. No.: 425,648

[22] Filed: Apr. 20, 1995

[51] Int. Cl.[6] ..... E05F 15/00

[52] U.S. Cl. ..... 49/139; 192/69.62

[58] Field of Search ..... 49/139, 140, 26; 192/69.8, 69.62, 69.71

[56] References Cited

U.S. PATENT DOCUMENTS

| | | | |
|---|---|---|---|
| 231,828 | 8/1880 | McCord | 192/69.62 |
| 456,827 | 7/1891 | Johnson | 192/69.62 X |
| 796,205 | 8/1905 | Mitchell | 192/69.62 |
| 3,643,642 | 2/1972 | Junes | 192/69.62 X |
| 5,048,653 | 9/1991 | Fellows | 192/69.62 |

*Primary Examiner*—Kenneth J. Dorner
*Assistant Examiner*—Jerry Redman
*Attorney, Agent, or Firm*—Ramon L. Pizarro; Edwin H. Crabtree

[57] ABSTRACT

A safety coupling device for manual disengagement of a drive mechanism to the counterbalance shaft on an overhead garage door mounted in a garage structure. The device includes a first annular hub mountable on the counterbalance shaft in a fixed position with relation to the counterbalance shaft. A second annular hub with a drive sprocket connected to a motor drive is rotatably and slideably mounted on the counterbalance shaft. At least one pin or protrusion is provided on one of the hubs so that the protrusion mates with at least one hole for accepting the pin or protrusion on the other hub. When the second hub is in a first position the pin or protrusion on one hub resides within the hole of the other hub and thus engages the two hubs and permits power from the motor drive to be transmitted to the counterbalance shaft in order to raise or lower the door by the motor drive. When the second hub is in a second position the pin or protrusion is withdrawn from the hole and the hubs are disengaged. Disengagement of the hubs allows the second hub to free wheel on the counterbalance shaft and thus disconnects the motor drive mechanism, allowing manual raising or lowering of the garage door. A lever is used to move the second hub between the first position and the second position in order to disengage or engage the hubs as desired.

13 Claims, 6 Drawing Sheets

UNIVERSAL QUICK RELEASE SAFETY SPROCKET AND DRIVING ASSEMBLY

BACKGROUND OF THE INVENTION (a) Field of the Invention

This invention generally relates to a universal safety release, or clutch, mechanism, and more particularly, but not by way of limitation, to a universal safety release for disengaging the drive mechanism to an overhead garage door having a counterbalance shaft.

(b) Discussion of the Prior Art

Many of today's automatic garage doors include a roll-up or swing-away type doors mounted on a counterbalance shaft that allows rotation of the door. The counterbalance shaft typically uses a large spring to react to the weight of the door, so that the door may be opened or closed with minimal effort or power.

Automatic garage doors also include some sort of an electric motor to provide the power that opens or closes the garage door. Present automatic garage door opening mechanisms are either of the center drive type or of the side mount type. With center drive mechanisms the electric motor drives a screw or a chain that in turn pulls on the top center area of the garage door. Side mounted systems, on the other hand, typically drive the counterbalance shaft in order to raise or lower the garage door.

There are many advantages to using a side mounted drive system. One of these advantages is that the side mounted system does not take up vertical space in the garage, and thus allows room for storage of taller vehicles. Another advantage is that the mechanism's drive unit can be mounted at the side of the garage entrance at a much lower, more accessible height than is required by the center drive. This facilitates maintenance and access to the drive mechanism in case of power failure or of mechanical failure of the drive mechanism.

Garage door drive mechanisms typically include some sort of drive disengagement device for disengagement of the drive mechanism when the unit is inoperative because of some sort failure. In center drive type of installations this disengagement mechanism is mounted somewhere along the mechanism that pulls on the central area of the garage door. However, a serious problem with this type of arrangement is that when the system fails with the door closed, and there is an automobile parked inside the garage, the user may have to climb on top of the car in order to reach the drive disengagement mechanism. This can place the user at risk of falling and injuring himself when trying to climb over the car, or can lead to damage to the vehicle. Also, the difficulties associated with disengaging the drive mechanism of a center drive may even cost precious time in emergency situations where power has been lost and the occupant of the home needs to escape the premises in a hurry. With side mounted devices, however, the drive mechanism can be mounted on the side of the garage where access to the drive disengagement mechanism is not a problem regardless of whether there is a vehicle in the garage.

The drive disengagement mechanism, therefore, is a very important safety element of the side mount mechanism. The drive disengagement mechanism must be very reliable and easy to access. Also, the disengagement mechanism should be easy to manufacture and install, and thus require few parts to operate.

The prior art includes several approaches at providing a drive disengagement mechanism for a side mount door drive. For example, U.S. Pat. No. 5,222,327 to Fellows et al. discloses a spring loaded disengagement system that permits sliding disengagement of a gear that is part of the gear drive train of a drive mechanism. The gear that permits disengagement in this arrangement is mounted on a splined hub that permits transmission of torque through the gear train. Because this system uses a gear train, each gear must be mounted on shafts with bearings or bushings, which makes manufacture and assembly somewhat complicated and expensive. Also, the gear train of the mechanism must be housed so that the gear and bearing surfaces are kept safely away from a user's extremities or from dust and contaminants that can shorten the life of the mechanism. Moreover, because the arrangement requires a housing the housing that must be used with a geared disengagement mechanism will also prevent easy examination of the components in order to trouble shoot the unit in case of a breakdown. Still further, the geared arrangement provides a fixed ratio of drive speed reduction due to the fact that gears have fixed diameter that require that the gear axles remain at fixed positions. This means that if a manufacturer or installer needs a slower or faster gear reduction, depending on the weight of the door and the application of the drive mechanism, one would probably have to provide an entirely new gear drive or install a different motor with a different motor speed control apparatus.

In yet another side mount door drive mechanism, U.S. Pat. No. 4,472,910 to Iha, shows a geared device including a gear having a set of integral raised projections that mate with an opening in a spring loaded rocker arm mounted on a pin that runs through the counterbalance shaft. One of the integral raised projections must be inserted into an opening in the rocker arm in order to transmit torque from the gear to the counterbalance shaft. This device is disadvantaged in that the system cannot be combined with other systems. In other words, the invention cannot be used in conjunction with other side mounted drive mechanisms, which limits the user's choice of sources of spare parts and components. Also, the Iha system is disadvantaged in that it uses a spring loaded rocker arm, which requires a rocker arm, two pins, a spring and an activation cam system in order to operate. This requires a large number of parts that must be manufactured, inventoried and maintained.

In yet another approach at solving the problems associated with disengaging the drive mechanism is the device taught by U.S. Pat. No. 3,512,302 to Sivin et al. The Sivin apparatus is a chain driven apparatus that includes a pair of sprockets that are connected together so that one sprocket serves to turn a shaft, like a counterbalance shaft, that supports and controls a overhead door. The other sprocket serves to control a limit switch. The two sprockets are tied to a drive motor by means of a pressure activated clutch, which can be engaged or disengaged by turning a threaded spindle against a pressure plate. The Sivin apparatus is simple and contains some inexpensive parts. For example, it uses chains and sprockets instead of gears. Also, it allows easy access to the clutch mechanism. However, the Sivin mechanism is disadvantaged in that it requires the use of many parts to produce the clutch mechanism. Also, in order to engage the clutch one must manually tighten a threaded spindle until it provides enough pressure against the clutch disks so as to prevent slippage. This brings to light one of the major disadvantages of the Sivin device. Many users may not be able to supply enough torque and hence pressure so as to prevent slippage. Also, temperature variations may cause expansion of the clutch elements so as to allow slippage after the mechanism had been tightened.

There remains, therefore, a need for a simple universal release mechanism for engaging and driving the door opening and closing mechanism of an automatic garage door. Importantly, there remains a need for a simple engagement mechanism that uses few parts, that can be used with side-mounted garage door drive mechanisms as well as other mechanisms manufactured by many different manufacturers, and can be easily accessed and operated regardless of whether a car is parked in the garage.

SUMMARY

It has been discovered that a quick release safety sprocket universal engagement and drive mechanism that permits quick release of the motorized drive unit of an overhead garage door having a counterbalance shaft can be achieved by means of a universal driving assembly that mounts on the counterbalance shaft of the overhead garage door. A preferred version of the driving assembly includes:

(a) a first annular hub mountable on a counterbalance shaft and having a first end and a second end, the first end having at least one pin or projection mounted substantially parallel to the counterbalance shaft, and a set screw or retaining means for securing the relationship of the first annular hub and the counterbalance shaft;

(b) a second annular hub slideably and rotatably mountable on a counterbalance shaft so that the hub may slide on and rotate about the counterbalance shaft, the second hub also includes a first and a second end, a peripheral track or groove between the first and second end, at least one aperture for receiving at least one pin or projection at the second end of the second hub so that the pin or projections on the first end of the first hub can mate with the aperture or apertures on the second hub, and a sprocket or pulley for accepting a drive chain or a flexible drive means is attached to the first end; and (c) a lever having a first end, a mid section pivotally attached to a support means, and a second end section having a handle, the first end being engageable with the track or groove in the second hub, so that by pulling the handle one may slide the second hub towards or away from the first hub so that the aperture or apertures in the second end of the second hub may engage or disengage with the pin or projections on the first end of the first hub, and thus allow engagement or disengagement of the first and the second hub.

In accordance with the subject invention, a drive mechanism including an electric motor is preferably mounted to the side of the garage door opening. The drive mechanism will preferably include a chain drive sprocket for driving the sprocket on the invention and, in turn, raising and lowering the garage door. In the event of a power failure or a failure of the drive mechanism the user may disconnect the drive mechanism from the garage door counterbalance shaft by simply pulling on the lever. Moving the lever causes the second hub to slide along the counterbalance shaft away from the first hub. This will cause the disengagement of the pin or projections and the aperture or apertures for receiving a pin or projections, and thus allow the second hub to spin freely about the counterbalance shaft, and thus allowing manual operation of the door.

The support means for pivotally attaching the lever may be, for example, a bracket attached to the exterior of the drive mechanism. The lever's handle should extend downward to allow easy access to the handle. The other end of the lever rides within the track or groove of the second hub. By mating the groove or track with the end of the pivotable lever one can cause the first hub to slide along the counterbalance shaft. Moving the handle portion of the lever causes the lever to pivot about its mid section and thus causes the first end of the handle to swing and move the second hub.

Therefore, by sliding the second hub back along the counterbalance shaft one can once again engage the first hub and the second hub by causing the engagement of the pin or projection on the first hub into the aperture for receiving the pin in the second hub. Once the pin or projection has been inserted and the hubs have once again been engaged, power transmitted from the drive unit through the sprocket on the second hub will be transmitted through the pin to the first hub. From the first hub, the power is then transmitted to the counterbalance shaft through a setscrew or other means for securing the first hub. As power is transmitted to the counterbalance shaft the garage door will be raised or lowered.

Thus it can be appreciated that it is an object of the instant invention to provide a universal safety release driving mechanism. Most modern garage doors include a counterbalance shaft. Therefore, the disclosed invention is truly universal because it can be mounted on a door with a counterbalance shaft.

Also, it is understood that the instant invention can also be used by the motorized drive mechanisms of a variety of manufacturers, and thus allow the installer a broader choice of power and functions for a particular installation.

Moreover, those skilled in the art will readily appreciate that another object of the instant invention is to provide an engagement and disengagement safety mechanism that involves few parts, and that takes advantage of the physical operating characteristics of components such as a drive chain's tendency to align the drive sprocket with the driven sprocket.

Still further, it can be appreciated that an object of the instant invention is to provide a simple engagement mechanism that allows easy access to the disengagement means. This will provide the user easy access to the disengagement mechanism regardless of whether there is an automobile parked in the garage.

It is yet another object to provide a disengagement mechanism that will quickly disengage the drive mechanism of a garage door, and thus provide a safety disengagement mechanism that allows the user to open the garage door in the event of a power failure or mechanical failure.

Thus the described universal quick release safety sprocket and driving assembly offers advantages in safety, access, simplicity, manufacturability and economy that could not be achieved by the prior art. These and other advantages and objects of the present invention will become apparent to those skilled in the art from the following detailed description, showing the contemplated novel construction, combinations and elements as herein described, and more particularly defined by the appended claims, it being understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for the practical principles hereof, and in which.

DESCRIPTION OF THE PREFERRED EMBODIMENTS

Figure 1:
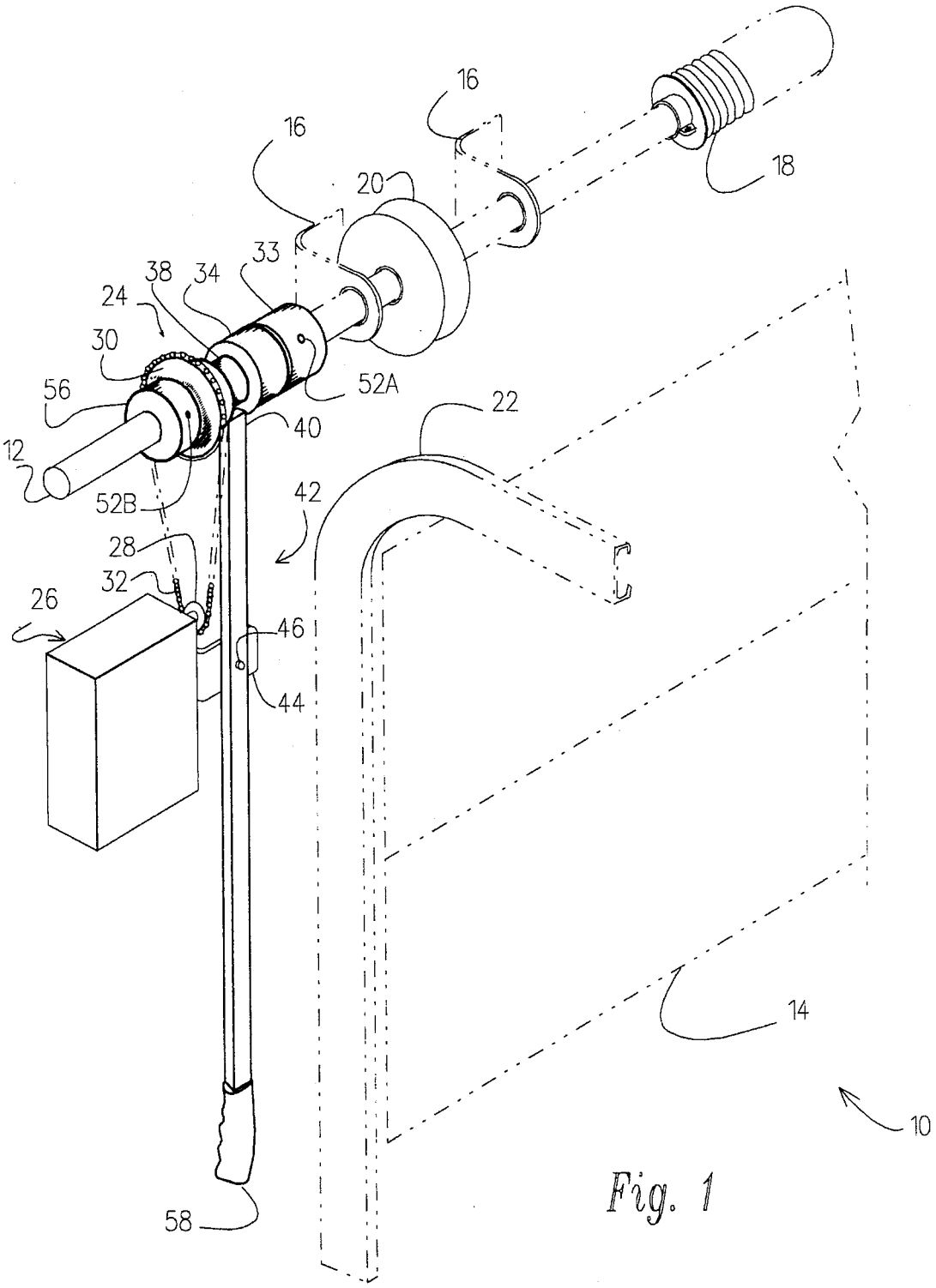
FIG. 1 is an isometric, perspective view of a preferred embodiment of the invention mounted on a counterbalance shaft.

In FIG. 1 an isometric view of a typical overhead garage door installation 10. The overhead garage door installation 10 is shown having a counterbalance shaft 12 for a garage door 14. The counterbalance shaft 12 is mounted to the garage structure by means of shaft support brackets 16. Mounted on the counterbalance shaft is a spring 18 for providing counterbalance torsion, and a cable spool 20 with cable (not shown) for lifting and lowering the door. The attachment of the cable to the door, as well as the cooperation of the counterbalance shaft 12, cable spool 20 and cable to lift the door, is conventional and will not be discussed in further detail. The garage door 14 is slideably mounted on conventional track rails 22, so that the door may slide between an open or shut position during operation.

Mounted on the counterbalance shaft 12 is the subject universal quick release safety sprocket driving assembly 24, herein after referred to as the "universal driving assembly" 24. The universal driving assembly 24 is mountable on the counterbalance shaft of an overhead garage door, and thus is universally applicable to garage doors with counterbalance shafts. As can be seen on FIG. 1, once mounted on the counterbalance shaft 12, the universal driving assembly 24 is driven by a conventional drive unit 26, which serves as a motor drive means and includes a motor, control circuitry, and other features found in automatic overhead garage door opening systems.

The drive unit 26 has a power output shaft that includes a drive sprocket 28. The drive sprocket 28 drives a main sprocket 30 on the universal driving assembly 24 by means of a flexible drive means, which in a preferred embodiment is a drive chain 32.

Figure 2:
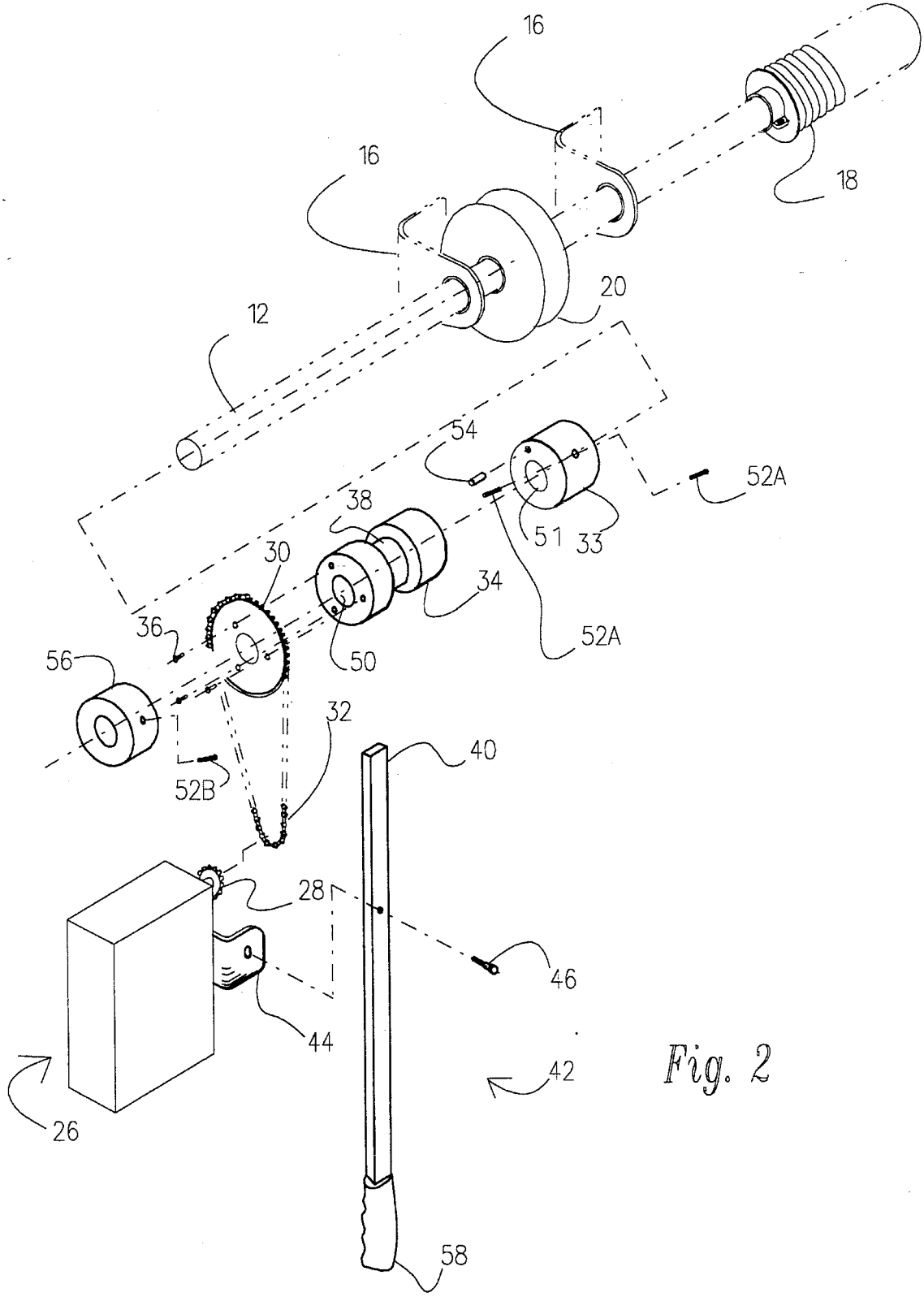
FIG. 2 is an exploded view of a preferred embodiment of the invention mounted on a counterbalance shaft.

As can be seen on FIG. 2, the universal driving assembly 24 includes a first hub 33, which can be annular in shape, and a second hub 34, which can also be annular in shape. The main sprocket 30 is attached to an end of the second hub 34 by means of conventional fasteners 36.

The second hub 34 includes a peripheral track or groove 38, which is bounded by a first shoulder 39A and a second shoulder 39B. It is to be understood that the same functions of the track or groove 38 could be accomplished with a groove that does not have the same geometric features as the preferred embodiment. For example, the first shoulder 39A and the second shoulder 39B and track 38 could be integrated into a single arcuate groove; this variation is taught here only for the purpose of providing an example of a variation of the embodiment broad invention shown here. As shown on FIG. 3, a preferred embodiment described here includes the peripheral track 38 that mates with an end 40 of a lever 42. As shown on FIG. 1, lever 42 is pivotally mounted to a lever support bracket 44 by means of a pivot pin 46, which in a preferred embodiment is a shoulder screw.

Figure 3:
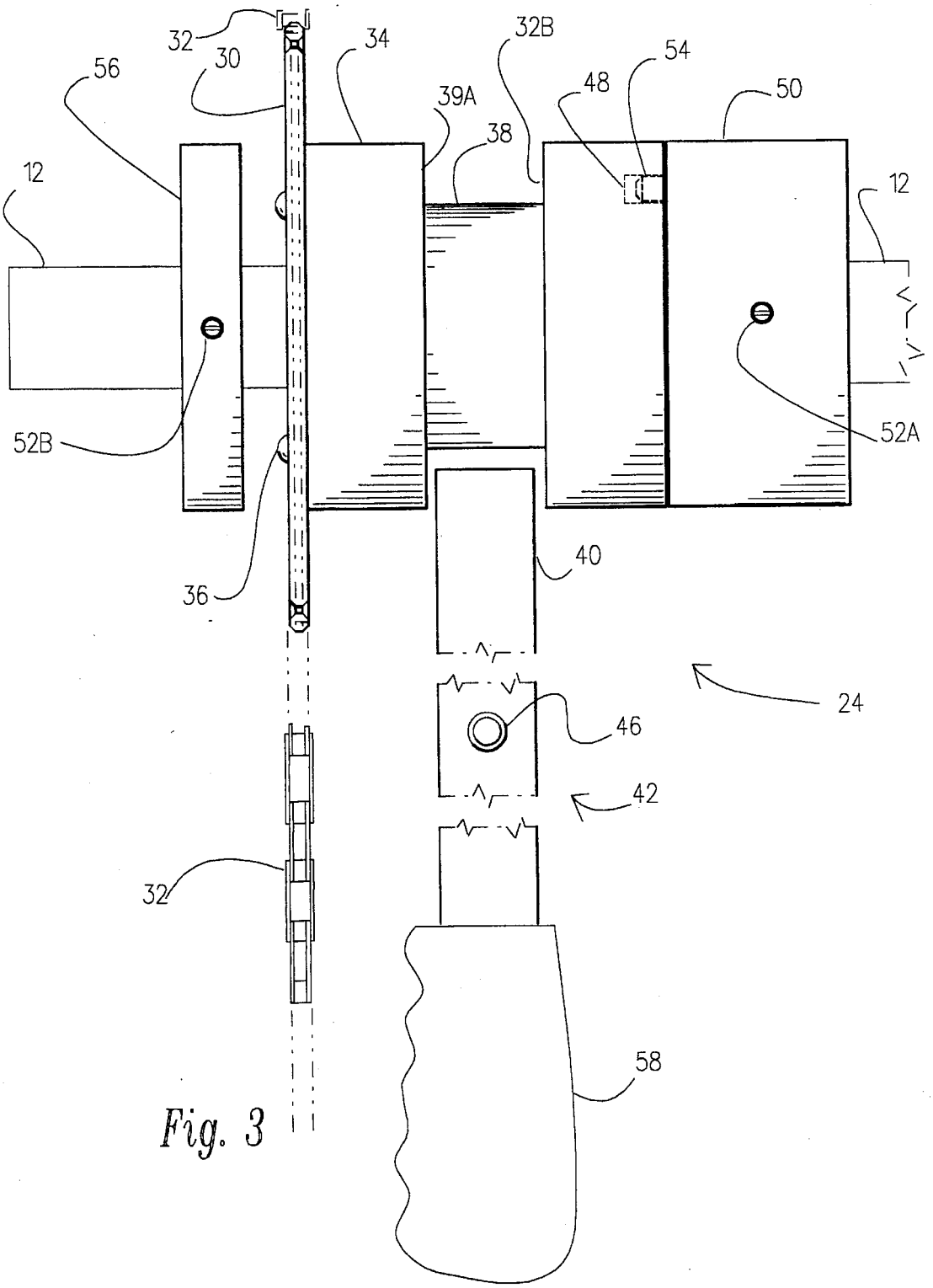
FIG. 3 is a side view of a preferred embodiment with the hubs interlocked so as to permit automatic raising and lowering of the garage door.
Figure 7:
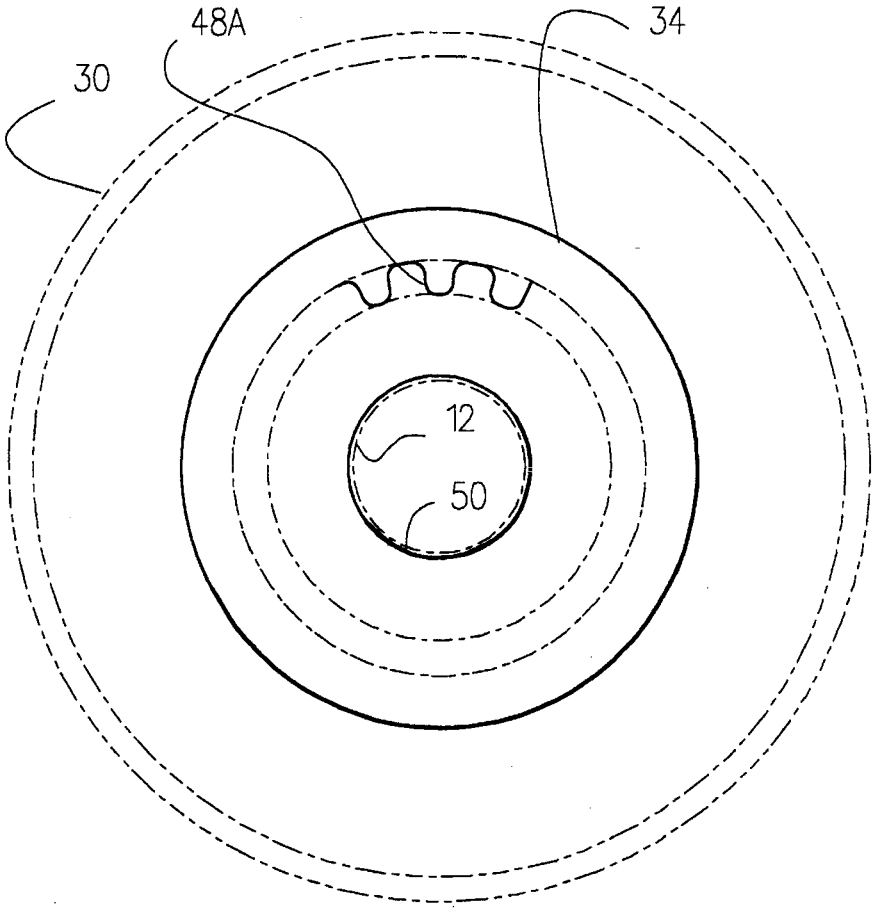
FIG. 7 is a is an end view of a variation of an embodiment of the second, or primary, hub, looking down the hole for the counterbalance shaft.

As is illustrated in FIG. 3, lever end 40 fits within the track 38 of the second hub 34. Also, from FIG. 3 it can be seen that the second hub 34 includes a drive pin receiver hole 48, which is depicted in more detail in FIG. 5. An alternative configuration for performing the function of the drive pin receiver hole 48 is shown as a drive means 48A, which is a means for accepting a protrusion on the first hub and serves for transferring torque from the second hub 34 to the first hub 33 as shown in FIG. 7. The drive pin receiver hole 48 is on an end of the second hub 34, opposite the end of the second hub 34 that includes the main sprocket 30. As can be appreciated from FIGS. 3, 4 and 5 the second hub 34 has a hole 50 therethrough, which permits the second hub 34 to slideably and rotatably mount on the counterbalance shaft 12. The hole 50 permits the second hub 34 to free-wheel and slide on the counterbalance shaft 12 when desired.

As can be seen in FIG. 3 the first hub 33 includes means for fastening or securing the first hub 33 to the counterbalance shaft 12. In a preferred embodiment of the invention at least one set screw 52A is used to fix the relationship of the driven hub 50 to the counterbalance shaft 12, however as is well known in the art many other means, such as shackles or pins, may be used to perform the same function as the set screw 52A.

Figure 6:
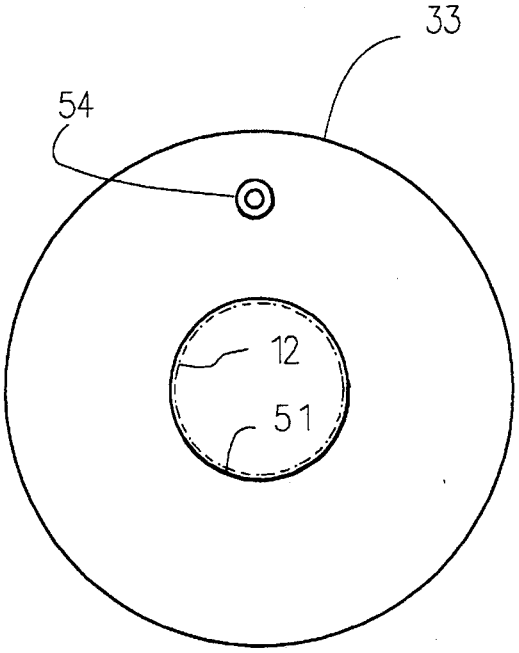
FIG. 6 is a is an end view of a preferred embodiment of the first, or driven, hub, looking down the hole for the counterbalance shaft.
Figure 8:
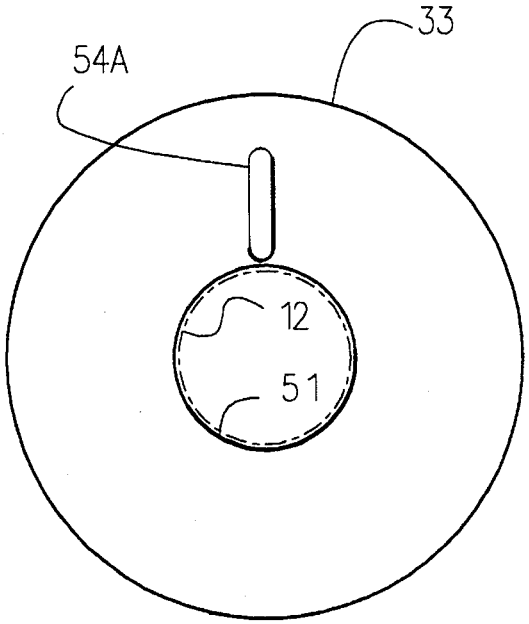
FIG. 8 is a is an end view of a variation of an embodiment of the first, or driven, hub, looking down the hole for the counterbalance shaft.

FIG. 3 also illustrates that one end of the first hub 33 includes a drive pin 54, which is further detailed in FIG. 6. In a preferred embodiment the drive pin 54 protrudes approximately ¼ of an inch from the face of the hub. It should be noted that a round drive pin 54 has been included in a preferred embodiment solely for its simplicity and ease of manufacture. For example, an alternative configurations for performing the function of the drive pin 54 is shown as a means for torque transfer 54A of the first hub 33 as shown in FIG. 8. The drive pin 54 mates with the drive pin receiver hole 48 on the second hub 34, so that any torsion from the drive unit 26 can be transmitted to the second hub 34. This allows torsion to be transmitted to the counterbalance shaft 12 through the engagement of the drive pin 54 and the drive pin receiver hole 48, and then through the first hub 33 to the counterbalance shaft 12 by means of the set screw 52A. Torsion transmitted to counterbalance shaft 12 will cause cable spool 20 to turn, and thus raise or lower the garage door 14 by means of the cable. Again, the embodiments shown on FIGS. 7 and 8 are included here as examples only, and serve to illustrate the broad scope of the instant invention.

As illustrated in FIG. 1, the instant invention can preferably be used with a locking collar 56 that mounts on the counterbalance shaft 12 and serves to limit the travel of the second hub 34. Like the first hub 33, the locking collar 56 is fixed by means of a set screw 52B. However, as is well known in the art the position of the locking collar 56 may be held by an ordinary screw or other means, such as shackles or pins, may be used to perform the same function as the set screw 52B.

In a preferred embodiment the travel of the second hub 34 is limited by the locking collar 56 to about ⅜ of an inch of travel. This leaves about ⅛ of an inch of travel between the end of the drive pin 54 and the end of the second hub 34 that contains the drive pin receiver hole 48. However, it should be emphasized here that these distances of travel have been found to work well, but experimentation will show that different distances of travel may also work well.

Thus when the second hub 34 is in one position, the instant invention 24 can be used to transmit torsional power from the drive unit 26 to the counterbalance shaft 12 in order to raise or lower the garage door 14. Because the second hub 34 is slideably mounted on the counterbalance shaft 12, the instant invention also serves to disconnect, or disengage, the drive unit 26 by moving the hub to a second position along the counterbalance shaft 12. And thus, disengagement is accomplished by simply sliding the second hub 34 away from the first hub 33 so that the drive pin 54 is withdrawn from the drive pin receiver hole 48. Once the drive pin 54 has been removed from the drive pin receiver hole 48, the second hub 34 can free-wheel due to the fact that removal of the drive pin 54 eliminates the shear continuity between the second hub 34 and the first hub 33. Thus, disengagement of the second hub 34 from the first hub 33 also disconnects the counterbalance shaft 12 from the drive unit 26. This disengagement permits the manual raising or lowering of the garage door 14.

The lever 42 serves as a means to slide the second hub 34 to a free wheeling position, and thus serves to release the power connection between the drive unit 26 and the counterbalance shaft 12. Sliding of the second hub 34 away from the first hub 33 is accomplished by moving the lever 42. As can be seen from FIG. 2, the lever 42 is pivotally mounted on the pivot pin 46 and has the lever end 40 on one side of the pivot 46 and a handle 58 on another side of the pivot pin 46. Thus, one can disconnect the drive unit 26 by moving the handle 58 to cause the lever 40 to rotate about the pivot 46.

To provide a mechanical advantage in disconnecting the second hub 34 a preferred embodiment of the lever 42 includes a ratio of the length from the pivot pin 46 to the handle 58 to the length from the pivot pin 46 to the lever end 40 of approximately three to one, and most preferably of about two to one. However, it is to be understood that these ratios may be varied depending on the accessibility of the counterbalance shaft 12, the intended use and the preferences of the user. Also, it is apparent that the variability of the length ratio of the lever 42 adds to the versatility of the invention.

FIG. 3 illustrates the second hub 34 and the first hub 33 with the drive pin 54 inserted in the drive pin receiver hole 48. In this relative position the drive unit 26 can drive the second hub 34 and the first hub 33 through the main sprocket 30, and thus permit the powered opening and closing of the garage door 14. As can be seen in FIG. 3, during normal, powered operation of the garage door 14, the lever end 40 merely resides within the peripheral track 38 on the second hub 34.

In case of a power outage or a malfunction within the drive unit 26, one may disengage the second hub 34 from the first hub by simply moving the handle 58 on the lever 42. In other words, a linear motion at the handle 58 will cause the disengagement of the second hub 34. By moving the handle 58 one causes the lever 42 to rotate about the pivot pin 46, which is mounted on the lever support bracket 44. Rotation of the lever 42 in turn causes the lever end 40 to move along an arc. This motion causes the lever end 40 to press against the track shoulder 39A. Pressure against the shoulder 39A of the peripheral track 38 causes the second hub 34 to slide along the counterbalance shaft 12 and to move away from the first hub 33, so that the drive pin receiver hole 48 moves away from the drive pin 54, which disengages the second hub 34 from the first hub 33 by withdrawing the drive pin 54 from the drive pin receiver hole 48.

Figure 4:
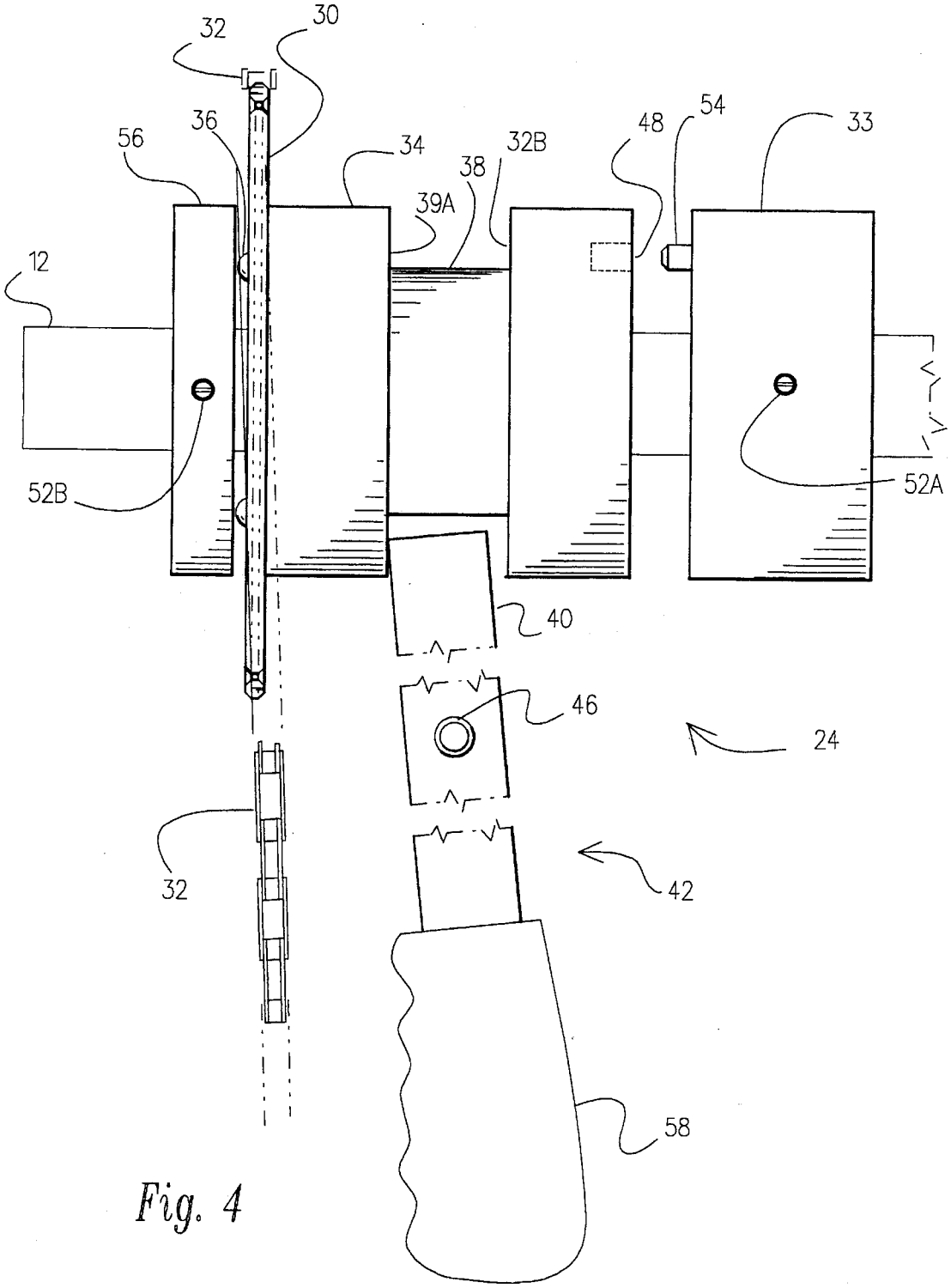
FIG. 4 is a side view of a preferred embodiment with the hubs disengaged so as to permit manual raising and lowering of the garage door.
Figure 5:
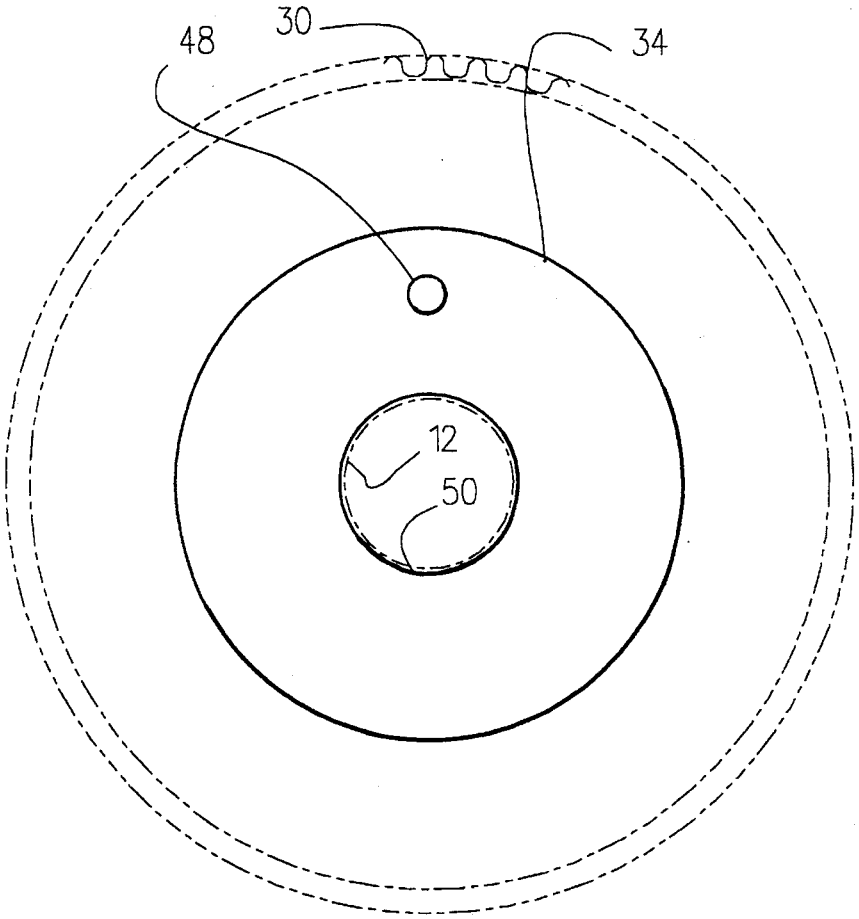
FIG. 5 is a is an end view of a preferred embodiment of the second, or primary, hub, looking down the hole for the counterbalance shaft.

FIG. 4 illustrates the condition where second hub 34 is disconnected from the first hub 33. Also, FIG. 4 illustrates the cooperation of lever end 40 and track shoulder 39A when pulling the lever 42 in order to disengage the second hub 34 from the first hub 33.

It is important to note that engagement of the second hub 34 and the first hub 33 through drive pin 54 is accomplished without the use of springs or other means that serve simply to bias the second hub 34 against the first hub 33. The instant invention takes advantage of the fact that the drive chain 32 cooperates with the main sprocket 30 to keep the second hub 34 in a position that results in coupling of the drive pin 54 and the drive pin receiver hole 48. In other words, the momentum and nature of the parallel linkages that make up the structure of the drive chain 32 keeps the second hub 34 and the first hub 33 in an engaged position. Thus, the invention allows the manufacturer to save on the manufacture, inventory and assembly of parts used by the prior art to keep the second hub 34 and the first hub 33 engaged.

Therefore, it is advantageous to use a chain as a means to transfer power from the drive unit 26 on to the invention 24 and to the counterbalance shaft 12. In addition to the cooperation in aligning the second hub 34 and the first hub 33, chain transmission permits easy adaptation to drive units from different manufacturers. Also, since the length of the chain 32 can be varied depending on the needs for a particular application, the chain transmission provides added flexibility with regards to accommodating the installation in a particular structure. Moreover, although the preferred embodiment includes a chain drive, it is to be understood that a belt drive may be used to achieve the alignment and flexibility required to achieve the functions of the instant invention.

In its normal, engaged, position the drive chain 32 maintains the second hub against the first hub 33, with the drive pin 54 fully inserted in the drive pin receiver hole 48. Disengagement of the two hubs is accomplished by moving the handle 58, which will cause the end of the lever 40 to travel along an arc, and thus push the second hub 34 away from the first hub 33 a total distance of approximately ⅜ of an inch along the counterbalance shaft 12. Clearly in this embodiment the protrusion of the drive pin 54, protrusion or other means used to connect the hubs must be less than approximately ⅜ of an inch from the end of the first hub 33 in order to establish a proper functional relationship. However, as stated earlier, the distance of motion of the second hub 34 can be varied without departing from the broad scope of this invention.

Also, it would be within the abilities of those with ordinary skill in the art to modify the lever 42 so as to include a forked end that mates with the track 38. Another variation to the means for sliding the second hub 34 along the counterbalance shaft 12 is a lever having a kink or bend that would accommodate differences in the geometry of the garage door support structure. Moreover, the lever 42 could also include adjustable, telescoping portions that would add to the adaptability of the installation. Similarly, an equivalent arrangement for sliding the second hub 34 along the counterbalance shaft 12 could include a mechanism having a forked end that would engage the track 38 and pull the second hub 34 in a rectilinear fashion to effect the disengagement of the second hub 34 and first hub 33.

Therefore, the above described embodiments are illustrative of just a few of the numerous variations of arrangements of the disclosed elements used to carry out the disclosed invention. Thus it is seen that the present invention provides a simple and effective universal quick release safety sprocket and drive mechanism which can be used to quickly disengage the drive mechanism on an overhead garage door.

While the invention has been particularly shown, described and illustrated in detail with reference to preferred embodiments and modifications thereof, it should be understood by those skilled in the art that the foregoing and other modifications are exemplary only, and that equivalent changes in form and detail may be made without departing from the true spirit and scope of the invention as claimed, except as precluded by the prior art.

What is claimed is:

1. A coupling device selectively coupling a motor drive means to a counterbalance shaft on an overhead garage door, the coupling device comprising:

a first hub having a hole therethrough for fixedly accepting the counterbalance shaft;

a second hub having a hole therethrough for accepting the counterbalance shaft, the hole in said second hub permitting slideable motion of the hub on the counterbalance shaft between a first and a second position along the counterbalance shaft, as well as permitting rotational motion of said second hub about the counterbalance shaft, said second hub further having means for accepting a flexible drive means from the motor drive means, the means for accepting a flexible drive means being attached to said second hub;

means for selectively engaging said second hub to said first hub when said second hub is in the first position, so that when said second hub is in the first position drive torsion from the motor drive means transmitted to said second hub may be transferred to said first hub and to the counterbalance shaft, and so that when said second hub is in the second position said means for selectively engaging does not engage said second hub to said first hub and thereby disengaging the motor drive means from the counterbalance shaft, and so that when said second hub is in the second position the second hub may be urged into the first position by the flexible drive means in response to actuation of the motor drive means.

2. A coupling device according to claim 1, wherein said means for selectively engaging comprises at least one protrusion from said first hub and at least one means for accepting the protrusion in said second hub.

3. A coupling device according to claim 2, wherein said means for accepting a flexible drive means is a sprocket for a drive chain.

4. A coupling device according to claim 3, wherein said coupling device further comprises means for moving said second hub between the first position and the second position.

5. A coupling device according to claim 4, wherein said means for moving said second hub between the first position and the second position is a lever.

6. A coupling device selectively coupling a motor drive means to a counterbalance shaft on an overhead garage door, the coupling device comprising:

a first hub having a hole therethrough for accepting the counterbalance shaft, said first hub further having a first end and at least one retaining means for securing a desired relationship between said first hub and the counterbalance shaft;

a second hub having a hole therethrough for accepting the counterbalance shaft so that said second hub may slide and rotate about the counterbalance shaft mounted therethrough, said second hub further having a first end, the first end of said second hub further having means for accepting a flexible drive means from the motor drive means, the means for accepting a flexible drive means being fixedly attached to said second hub, and said second hub further having a second end opposite the first end;

means for selectively engaging said second hub to said first hub; and means for moving said second hub along the counterbalance shaft from a first position to a second position on the counterbalance shaft, so that when said second hub is in the first position said means for selectively engaging engages said second hub to said first hub so that torsional power transmitted from the drive means to the first end of said second hub may be transferred to said first hub, so that when said second hub is in the second position said means for selectively engaging does not engage said second hub to said first hub, and so that When said second hub is in the second position the second hub may be urged into the first position by the flexible drive means in response to actuation of the motor drive means.

7. A coupling device according to claim 6, wherein said means for selectively engaging comprises at least one pin protruding from the first end of said first hub and at least one pin receiver hole in the second end of said second hub.

8. A coupling device according to claim 7, wherein said means for accepting a flexible drive means is a sprocket for a drive chain.

9. A coupling device according to claim 8, wherein said means for sliding said second hub is a lever.

10. A coupling device selectively coupling a motor drive means to a counterbalance shaft on an overhead garage door, the coupling device comprising:

a first annular hub having a hole for accepting the counterbalance shaft, said first annular hub further having a first end, and at least one retaining means for securing a desired relationship between said first annular hub and the counterbalance shaft;

a second annular hub having a hole therethrough for accepting the counterbalance shaft so that when the counterbalance shaft is mounted through the hole the hub may slide and rotate about the counterbalance shaft mounted therethrough, said second annular hub further having:

a first end, the first end of said second annular hub further having means for accepting a flexible drive means from the motor drive means, the means for accepting a flexible drive means being fixedly attached to said first end of said second annular hub, a second end opposite the first end of said second annular hub, and a peripheral groove between the first end of said second hub and the second end of said second hub;

means for engaging the peripheral groove on said second hub and urging said second hub to slide along the counterbalance shaft from a first to a second position along the counterbalance shaft; and means for selectively engaging the second end of said second hub to the first end of said first hub, so that when said second hub is in the first position said means for selectively engaging engages the second end of said second hub to the first end of said first hub so that power from the drive means transmitted to the first end of said second hub may be transmitted through said means for selectively engaging to said first hub, so that when said second hub is in said second position said means for selectively engaging does not engage said second hub to said first hub, and so that when said second hub is in the second position the second hub may be urged into the first position by the flexible drive means in response to actuation of the motor drive means.

11. A coupling device according to claim 10, wherein said means for selectively engaging comprises at least one pin in the first end of said first hub and a pin receiver hole in the second end of said second hub.

12. A coupling device according to claim 11, wherein said means for accepting a flexible drive means is a sprocket for drive chain.

13. A coupling device according to claim 12, wherein said means for sliding said second annular hub is a lever.

* * * * *